US005844499A

United States Patent [19]

Min

[11] Patent Number: 5,844,499

[45] Date of Patent: Dec. 1, 1998

[54] METHOD AND APPARATUS FOR RECOVERING ERASED CALLING MESSAGES IN RADIO PAGER

[75] Inventor: Yong-Ki Min, Suwon, Rep. of Korea

[73] Assignee: SamSung Electronics Co., Ltd., Kyungki-do, Rep. of Korea

[21] Appl. No.: 691,494

[22] Filed: Aug. 2, 1996

[30] Foreign Application Priority Data

Aug. 10, 1995 [KR] Rep. of Korea ..... 1995-24725

[51] Int. Cl.[6] ..... G08B 5/22

[52] U.S. Cl. ..... 340/825.44; 455/38.2

[58] Field of Search ..... 340/825.44–825.48, 340/825.22; 455/31.2, 38.1, 458

[56] References Cited

U.S. PATENT DOCUMENTS

| | | | |
|---|---|---|---|
| 5,077,830 | 12/1991 | Mallia | 455/38.1 |
| 5,479,408 | 12/1995 | Will | 340/825.44 |
| 5,579,472 | 11/1996 | Keyworth, II et al. | 340/825.44 |
| 5,673,036 | 9/1997 | Gabrielle | 340/825.44 |
| 5,694,454 | 12/1997 | Hill et al. | 340/825.44 |

*Primary Examiner*—Brian Zimmerman
*Assistant Examiner*—Edward Merz
*Attorney, Agent, or Firm*—Robert E. Bushnell, Esq.

[57] ABSTRACT

In a radio pager which includes: a memory having a memory area for sequentially storing calling messages, and a message table which includes a first area and a second area and stores addresses of the memory area where calling messages are stored; and an operation panel which has a calling message delete key and an erased calling message recovery key, and displays calling messages stored in a selected address when an address of the memory area stored in the first area of the message table is selected, a method and apparatus for recovering an erased calling message includes: moving an address of the memory area where a calling message to be erased is stored among the addresses stored in the first area of the message table into the second area, while maintaining the storage of the calling message to be erased in the memory area when the calling message delete key is pressed; arranging the remaining addresses stored in the first area except for the address moved into the second area; and moving a selected address into the arranged first area when the erased calling message recovery key is pressed and simultaneously selecting one address in the addresses stored in the second area.

6 Claims, 4 Drawing Sheets

METHOD AND APPARATUS FOR RECOVERING ERASED CALLING MESSAGES IN RADIO PAGER

CLAIM OF PRIORITY

This application makes reference to, incorporates the same herein, and claims all benefits accruing under 35 U.S.C. §119 from an application for METHOD FOR RECOVERING ERASED CALLING MESSAGE IN RADIO PAGER earlier filed in the Korean Industrial Property Office on 10 Aug., 1995 and there duly assigned Ser. No. 24725/1995.

BACKGROUND OF THE INVENTION

1. Field of the Invention

The present invention relates to a radio pager, and more particularly, to a method and apparatus for recovering erased calling messages in a radio pager.

2. Description of the Related Art

In general, a radio pager receives and analyzes calling information of a specific form, and when the received calling information is information directed thereto, performs a function of displaying the received information or alerting a user.

A general radio pager has a function of storing a received calling message. A user can check the stored calling message at any time by operating a calling message check key.

Furthermore, the radio pager has a function of erasing the calling messages. A user can erase an unnecessary calling message by operating a calling message delete key, thereby deleting a message or messages stored in a memory of the radio pager.

Thus, a general radio pager has a calling message erasing function as well as a calling message storing function and is capable of storing received calling messages and is also capable of erasing unnecessary calling messages. However, the radio pager does not have a function of recovering erased calling messages once the calling message has been carelessly erased by the user. Thus, it is impossible to again check an erased calling message in a conventional radio pager.

SUMMARY OF THE INVENTION

Accordingly, it is an object of the present invention to provide a method and apparatus for recovering a calling message by only moving an address of the memory area where the calling message intended to be erased is stored into another area of a message table and controlling the moved address by using an erasure pointer when a recovery of an erased calling message is requested.

It is another object of the present invention to provide a method and apparatus for moving a message table pointer so as to point to an initial address of the message table when an erasure of all of the calling messages stored in a memory area is requested, and controlling the message table pointer to again point to the address that the message table pointer pointed to before it was moved when a recovery of the calling messages is requested.

To achieve these and other objects according to the principles of the present invention, a radio pager according to the present invention includes: a memory comprising a memory area for sequentially storing calling messages and a message table, which comprises a first area and second area, and stores addresses of the memory area where the calling messages are stored; and an operation panel which has a calling message delete key and an erased calling message recovery key. Moreover, a micro-controller in accordance with the present invention stores received calling messages and checks the stored calling messages by using a message table pointer which points to the first area of the message table, and checks erased calling messages by using an erasure pointer which points to the second area of the message table. When the erased message recovery key is pressed, the micro-controller moves an address of the memory area stored in the second area of the message table into the first area of the message table, thereby recovering an erased calling message.

BRIEF DESCRIPTION OF THE DRAWINGS

A more complete appreciation of the invention, and many of the attendant advantages thereof, will be readily apparent as the same becomes better understood by reference to the following detail description when considered in conjunction with the accompanying drawings in which like reference symbols indicate the same or similar components, wherein.

DETAILED DESCRIPTION OF THE PREFERRED EMBODIMENT

Figure 1:
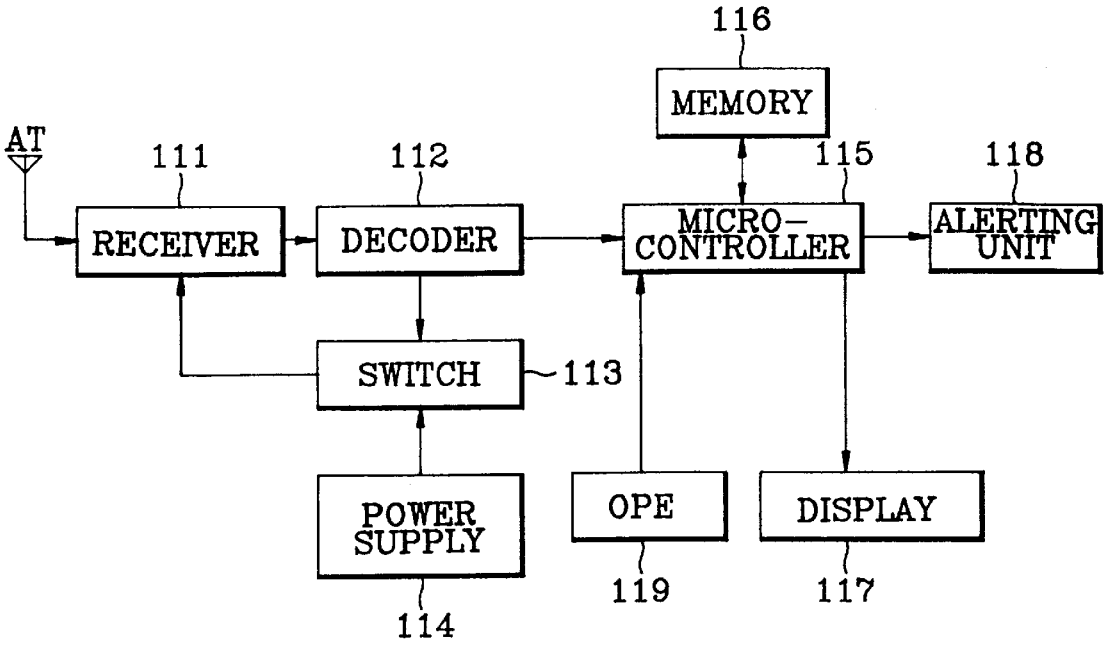
FIG. 1 is a block diagram illustrating a general radio pager.

In the radio pager illustrated in FIG. 1, a receiver 111 receives calling information through an antenna AT and performs frequency modulation/demodulation and waveform shaping. An output of the receiver 111, which is digital calling information data, is supplied to a decoder 112. The decoder 112 decodes the received data, and designates an operation mode of the radio pager. That is, in an idle mode, the decoder 112 controls the supply of operating power from the power supply 114 at a given time period in order to detect preamble data, and in a batch mode, detects word synchronization data and set frame data. The decoder 112 then decodes the detected frame data into original data.

A micro-controller 115 controls the overall operations of the radio pager and receives decoded data outputted from the decoder 112 and generates an alert control signal or a display control signal. An alerting unit 118 generates an alert signal such as a tone signal or a vibration signal for informing the user that a calling message has been received in response to the alert control signal outputted from the micro-controller 115. A display 117 displays a calling message and information about the status of the radio pager in response to the display control signal outputted from the micro-controller 115. A memory 116 comprises an EEPROM (Electrically Erasable Programmable Read-Only Memory) and a RAM, and stores specific address information and frame information which are allocated to the radio pager and the calling message processed by the micro-controller 115. An operation panel (OPE) 119 includes an alert setting key, a calling message check key and a calling message delete key. Accordingly, the user can select the alert signal as either one of the tone signal and the vibration signal by using the alert setting key and therefore, when calling information is received, the user may be alerted by the tone signal or the vibration signal based upon his selection. Furthermore, the user is able to check the calling message stored in the memory 116 by using the calling message check key and can also delete the calling message stored in the memory 116 by using the calling message delete key.

Figure 2:
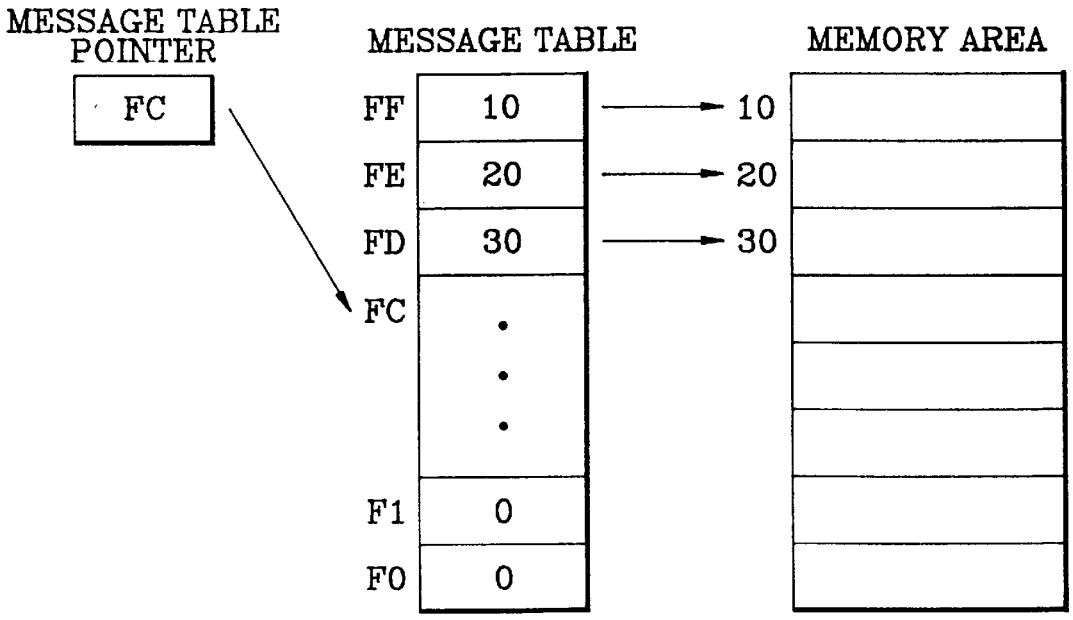
FIG. 2 is a diagram for use in describing a state in which a calling message is stored in a memory of FIG. 1.

The general radio pager constructed as described previously has a function of storing the received calling message and therefore, the user is able to check the stored calling message at any time by using the calling message check key on the OPE 119. FIG. 2 shows a state in which the calling message is stored in the memory 116 of FIG. 1. The memory 116 comprises a memory area for storing the calling message and a calling message table for storing information for administering the memory area, i.e., addresses of the memory area where the calling messages are stored. Therefore, if the user presses the calling message check key of the OPE 119 in order to check the received calling messages, the micro-controller 115 displays the calling message stored in memory area of the corresponding address with reference to the address stored in the message table on the display unit 117. Furthermore, if a new calling message is received, the micro-controller 115 stores the calling message in a vacant memory area with reference to the address stored in the message table.

For efficiently performing the operations mentioned above, the micro-controller 115 employs a message table pointer for indicating how much of the message table is filled. That is to say, if the calling message check key is pressed, the micro-controller 115 checks how much of the message table is filled by using the present message table pointer and then sequentially displays the calling messages stored in the memory area on the display unit 117. Furthermore, if the new calling message is received, the micro-controller 115 firstly checks how much of the message table is filled by using the message table pointer, and next checks the address of the memory area for storing the received calling message, and then stores the new calling message in the corresponding address.

Referring to FIG. 2, the address of the message table pointed to by the message table pointer is FC, and this indicates that the message table is filled from FF to FD and also means that three calling messages have been received. The first received calling message is stored in the address 10 of the memory area stored in the address FF of the message table, and the next received calling message is stored in the address 20 of the memory area stored in the address FE of the message table. The last received calling message is stored in the address 30 of the memory area stored in the address FD of the message table. If the radio pager had not received any calling messages, all of the areas of the message table would be filled with a value "0".

Figure 3:
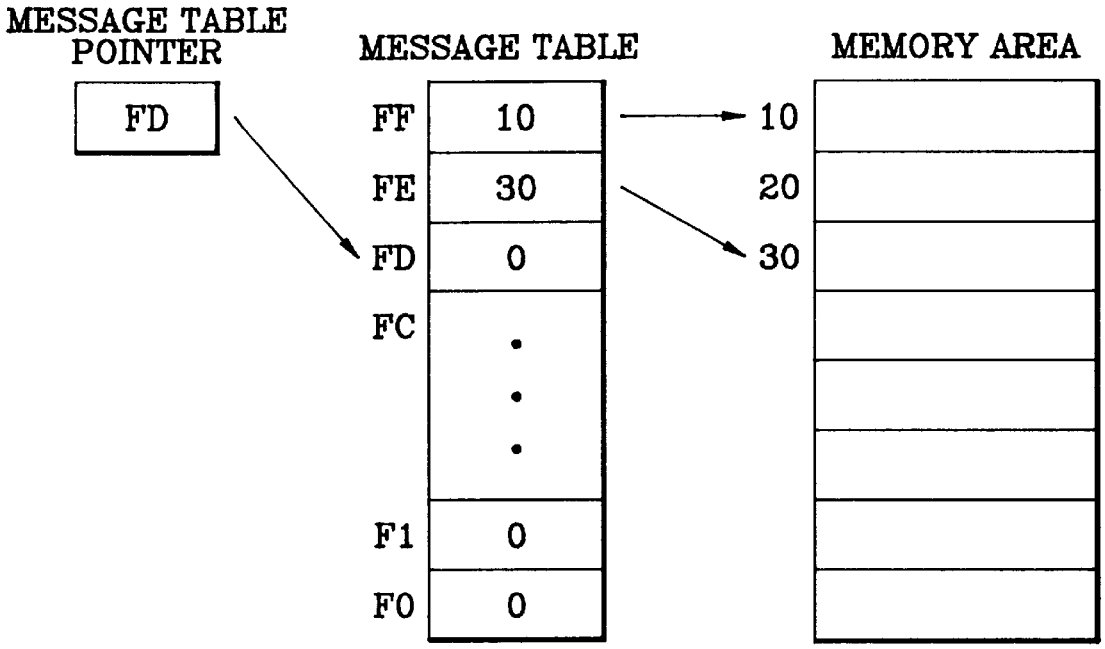
FIG. 3 is a diagram for use in describing a state in which a stored calling message is erased according to a conventional technique.

Furthermore, the radio pager has a function of erasing the calling messages and therefore, the user can erase an unnecessary calling message by using the calling message delete key of the OPE 119. As shown in FIG. 2, in a situation when three calling messages are stored, if the user deletes the second received calling message, i.e., the calling message stored in the memory area 20, the status of the message table is changed as shown in FIG. 3. That is, if the calling message stored in the memory area 20 is erased, the address 20 of the memory area stored in the address FE of the message table is also erased and accordingly, the address 30 of the memory area is newly stored in the address FE of the message table. Thereby, the message table pointer points the address FE of the message table, thereby to indicate that there are two received calling messages.

The general radio pager as described above has the calling message erasing function as well as the calling message storing function and therefore, is capable of storing the received calling message and also erasing the unnecessary calling message in the received calling messages. However, the radio pager does not have a function of recovering an erased calling message and therefore, once the calling message is erased carelessly, it is impossible to again check the erased calling message in the conventional radio pager.

In the present invention, the calling message delete key and the erased calling message recovery key can be embodied as separate keys of an operation panel. However, in a commercial product, it is preferred that these keys be embodied as one function key. In other words, the calling message delete key and the erased calling message recovery key can be embodied according to the number of times that one function key is pressed.

Three embodiments of the present invention are explained below. In the first embodiment, the radio pager individually recovers calling messages which are separately erased. In the second embodiment, it recovers all of the erased calling messages at once. In the third embodiment, the radio pager recovers the erased calling messages by identification number IDs when calling messages stored by identification number IDs are erased.

Assuming that three calling messages are stored in the memory 116 of FIG. 1 as shown in FIG. 2, the message table pointer points to FC and an erasure pointer points to F0. In this situation, if a user presses the calling message check key on the OPE 119, the micro-controller 115 checks that three calling messages have been stored by the message table pointer which is pointing to address FC of the calling message table. Then, the micro-controller 115 reads addresses of the memory area stored in the addresses FF, FE and FD of the message table and changes the calling messages stored in each memory area to display the data on the display 117.

Figure 4:
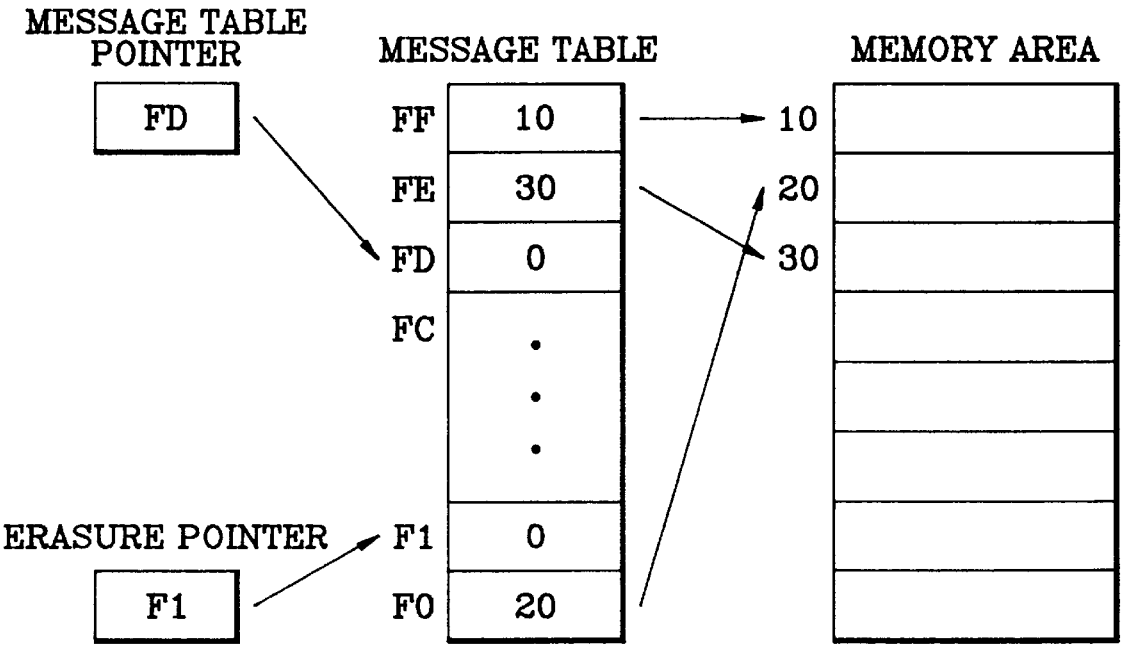
FIG. 4 is a diagram for use in describing a state in which a stored calling message is erased according to a first embodiment of the present invention.

When a calling message to be erased, e.g., the second calling message stored in the memory area, is displayed on the display 117, if the user presses the calling message delete key on the OPE 119, the micro-controller 115 moves the address 20 of the memory area where the calling message to be erased is stored into an area of the final address F0 of the message table, and moves address 30 of the memory area which has been stored in the address FD into the address FE, of the message table. At this time, the message table pointer points to FD, and the erasure pointer points to F1. FIG. 4 is a diagram showing that the memory area, the message table, the message table pointer and the erasure pointer are changed when the erasure of the calling message stored in the memory area 20 is requested, and in FIG. 4, the calling message to be erased is still stored in the memory area 20.

Figure 5:
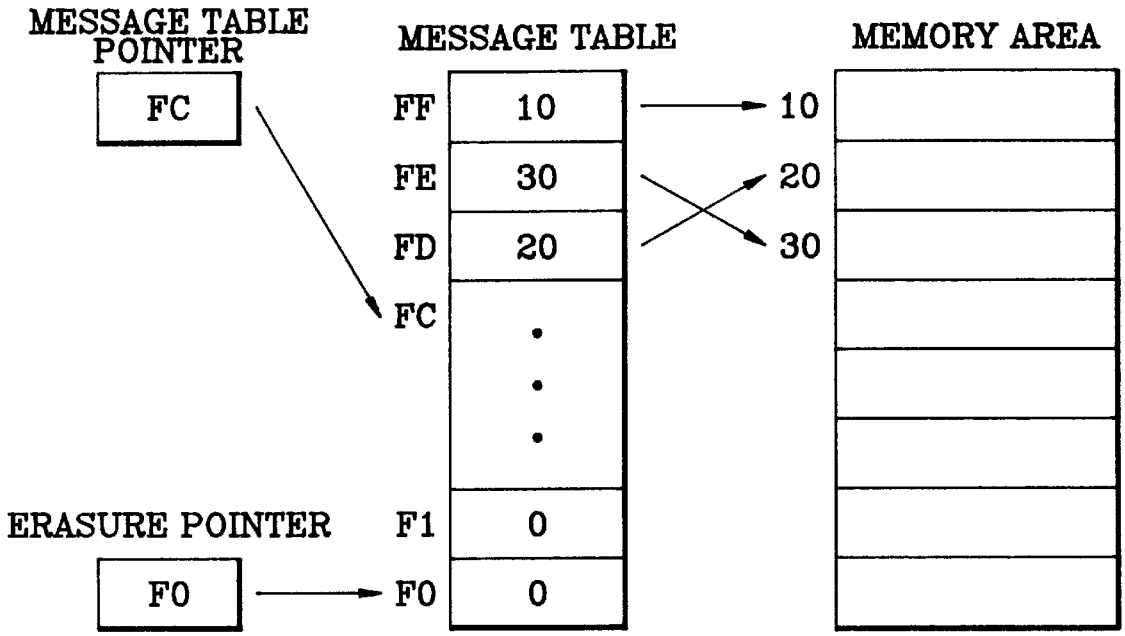
FIG. 5 is a diagram for use in describing a state in which the stored calling message is recovered according to the first embodiment of the present invention.

If the user presses the erased calling message check key of the OPE 119 after erasing the calling message stored in the memory area 20, the micro-controller 115 checks the number of the erased calling messages by using the erasure pointer, and reads the address 20 of the memory area stored in the address F0 of the message table. Then, the micro-controller 115 displays the calling message stored in the memory area 20 on the display unit 117. In the above case, the recovery operation for one erased calling message is described, but in case a plurality of calling messages have been erased, all of the erased calling messages can be recovered. Then, if the user presses the erased calling message recovery key of the OPE 119, the address 20 of the memory area stored in the address F0 of the message table is moved into the address FD of the message table, so as to be stored. Accordingly, the message table pointer again points to the address FC, and the erasure pointer points to the address F0. FIG. 5 is a diagram showing that the memory area, the message table, the message table pointer and the erasure pointer are changed when the calling message stored in the memory area 20 is erased and then again recovered, and shows that the calling message to be erased has been recovered. When the erased calling message is recovered, the number of the recovered calling messages stored in the memory area is the same as the original number thereof, and merely, the received sequence of the calling messages is changed.

As to the second embodiment, assuming that three calling messages are stored in the memory 116 of FIG. 1 in the same manner as the first embodiment, the message table pointer points to FC, and the erasure pointer points to F0. In this situation, if the user presses the calling message check key on the OPE 119, the micro-controller 115 checks that three calling messages have been stored by the message table pointer which is pointing to the address FC of the message table. Then, the micro-controller 115 reads the addresses of the memory area stored in the addresses FF, FE and FD of the message table and changes the calling messages stored in each memory area to display the data on the display 117.

Figure 6:
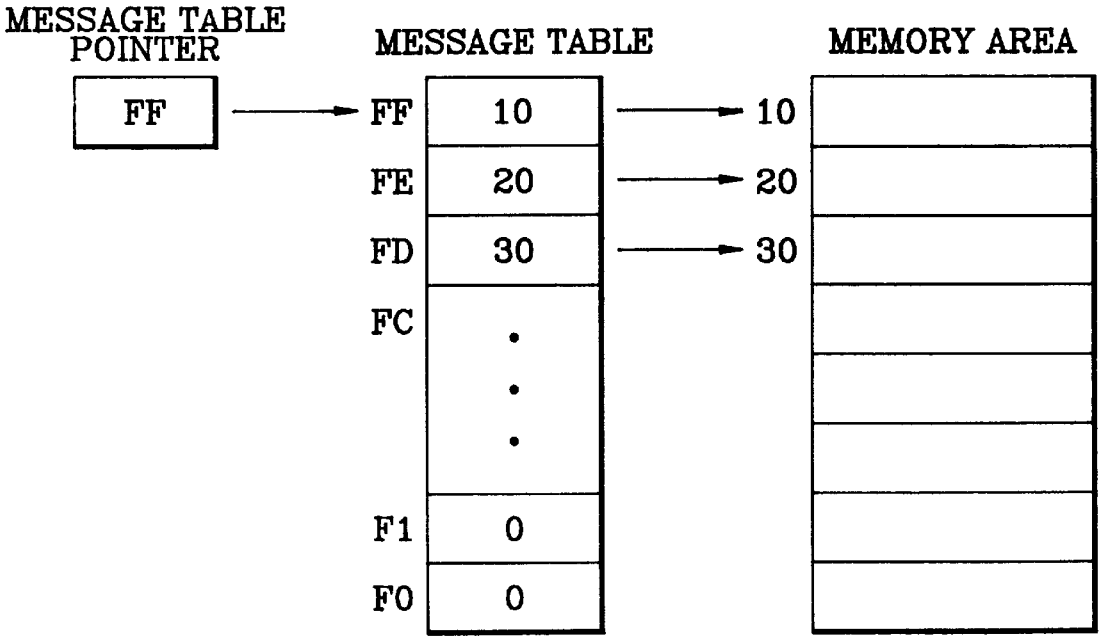
FIG. 6 is a diagram for use in describing a state in which a stored calling message is erased according to a second embodiment of the present invention.

When all of the received calling messages are displayed on the display 117, if the user presses the calling message delete key on the OPE 119 in order to erase all of the calling messages, the micro-controller 115 controls the message table pointer so as to point to the initial address FF of the message table. FIG. 6 is a diagram showing that the address of the message table pointed by the message table pointer is changed from FC to FF when the erasure of all the calling messages stored in the memory area is requested.

In this situation, if the calling message check key is pressed, the micro-controller 115 informs the user that there is no received calling message, but three calling messages are still stored in the addresses 10, 20 and 30 of the memory area. If the user presses the erased calling message recovery key of the OPE 119, the micro-controller 115 checks all of the areas of the message table and searches for all values except for the value "0". That is, the micro-controller 115 checks the addresses of the memory area where the calling messages to be erased are stored. Accordingly, the addresses 10, 20 and 30 of the memory area stored in the addresses FF, FE and FD of the message table are checked and therefore, the micro-controller 115 recovers the calling messages stored in the addresses of all of the checked memory areas. This recovery operation is performed by simply changing the address pointed to by the message table pointer from FF to FC.

On the other hand, the operation of individually or as a whole recovering three erased calling messages can be applied to a radio pager for receiving the calling messages by identification number IDs. However, for performing this recovery operation, the radio pager has to be provided with the message table, the message table pointer and the erasure pointer corresponding to each ID, respectively. Accordingly, in case that the above three components are provided, the checking operation of the stored calling messages, the calling message erasing operation and the erased calling message recovering operation are performed for each ID of the received calling messages. Therefore, the calling messages which are stored by IDs and then erased can be recovered by manipulating message table pointer, the erasure pointer and the message table corresponding to the ID selected by the user.

Figure 7:
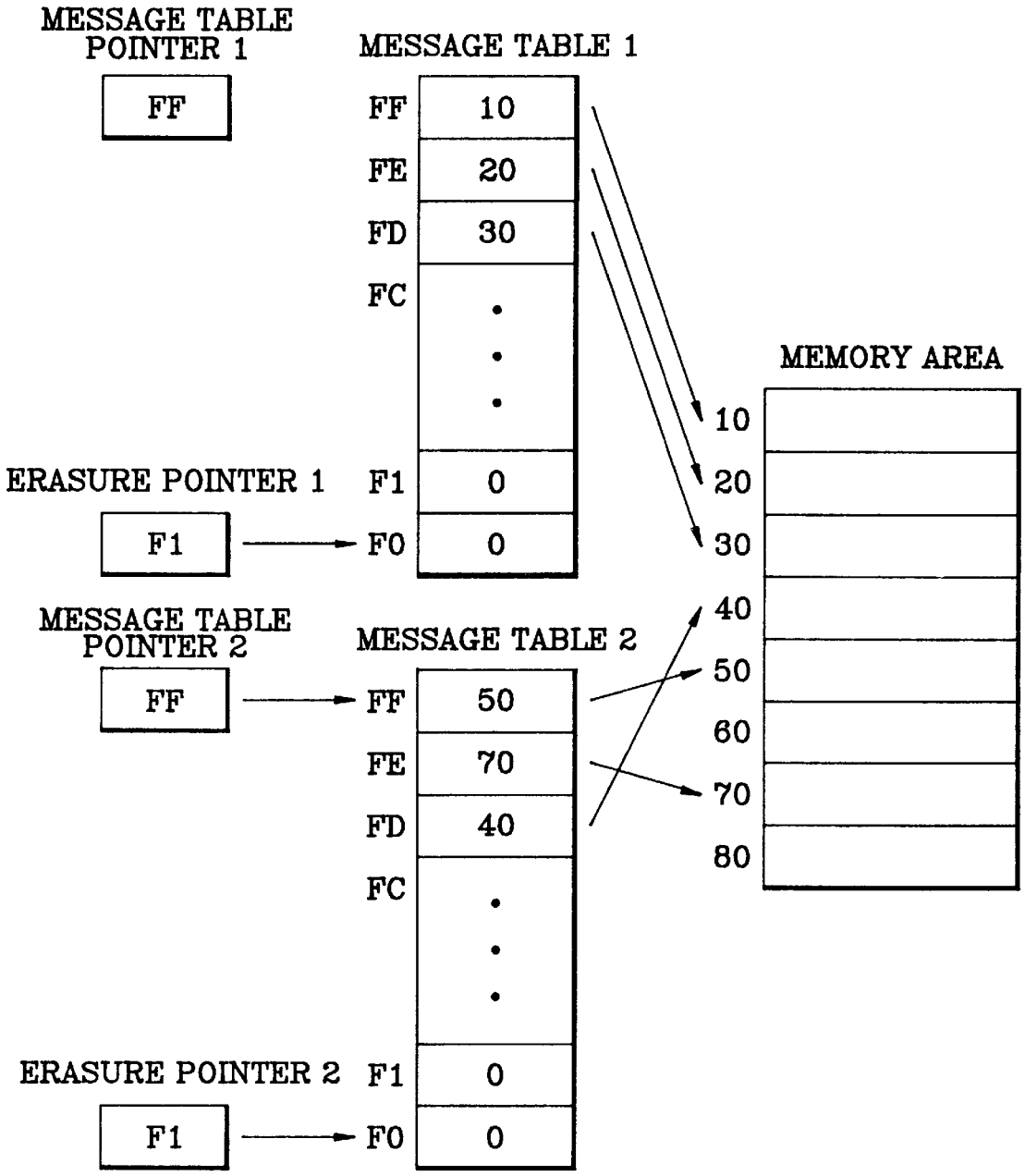
FIG. 7 is a diagram for use in describing a state in which a stored calling message is erased according to a third embodiment of the present invention.

FIG. 7 is a diagram showing a state in which the calling messages stored by two kinds of IDs are erased and again recovered, and shows that the radio pager is provided with two message tables, message table pointers and the erasure pointers, respectively. Furthermore, in FIG. 7, the message table, the message table pointer and the erasure pointer are respectively processed according to each ID of the stored calling messages. It will be understood by those skilled in the art that the erased calling message by each ID are recovered with reference to the explanations for the first and second embodiments discussed above.

As described above, the present invention has an advantage in that the erased calling messages can be recovered by controlling the calling message to be erased with the erasure pointer while the calling message to be erased is held in the memory area.

It should be understood that the present invention is not limited to the particular embodiment disclosed herein as the best mode contemplated for carrying out the present invention, but rather that the present invention is not limited to the specific embodiment described in this specification except as defined in the appended claims.

What is claimed is:

1. A method of recovering an erased calling message in a radio pager comprising:

providing a memory in the pager comprising a memory area for sequentially storing calling messages, and a message table which comprises a first area and a second area and stores addresses of the memory area where calling messages are stored;

providing an operation panel for the pager which has a calling message delete key and an erased calling message recovery key;

providing a display for the pager for displaying calling messages stored in a selected address when an address of the memory area stored in the first area of said message table is selected;

moving an address of the memory area where a calling message to be erased is stored among the addresses stored in the first area of the message table into the second area, while storing the calling message to be erased in the memory area when the calling message delete key has been pressed while maintaining the storage of the calling message to be erased in the memory area;

rearranging remaining addresses stored in the first area except for the address moved into the second area; and moving a selected address into the rearranged first area when the erased calling message recovery key has been pressed and simultaneously selecting one address of the addresses stored in the second area.

2. A method of recovering an erased calling message in a radio pager comprising:

providing a memory in the pager composing a memory area for sequentially storing calling messages, and a message table which comprises a first area and a second area and stores addresses of the memory area where calling messages are stored;

providing an operation panel for the pager which has a calling message check key, a calling message delete key and an erased calling message recovery key;

storing a calling message received in an address pointed to by a message table pointer from among addresses of the memory area stored in the first area of the message table;

providing a display for the pager for displaying all of the calling messages stored in addresses of the memory area stored in the first area of the message table when the calling message check key has been pressed;

moving an address of the first area of the message table storing address of the memory area where a calling message to be erased is stored into the second area when one calling message of the calling messages is displayed and the calling message delete key has been pressed while maintaining the storage of the calling message to be erased in the memory area;

reducing a message table pointer value pointing to an address of the message table which is storing the address of the memory area for storing a received calling message and generating an erasure pointer pointing to the address for storing the address of the first area of the message table intended to be next moved, when the address of the first area of the message table is moved into the second area of the message table;

rearranging remaining addresses stored in the first area except for the address moved into the second area;

moving a selected address into the first area when the erased calling message recovery key has been pressed and simultaneously selecting one address of the addresses stored in the second area; and increasing the message table pointer value and reducing the generated erasure pointer value, when the selected address of the addresses stored in the second area of the message table is moved into the first area of the message table.

3. A method of recovering an erased calling message in a radio pager comprising:

providing a memory in the pager comprising a memory area for sequentially storing calling messages and a message table for storing addresses of the memory area where calling messages are stored;

providing an operation panel for the pager which has a calling message check key, a calling message delete key and an erased calling message recovery key;

storing the calling message received in an address of the memory area stored in an address of the message table pointed to by a message table pointer;

providing a display for the pager for displaying calling messages stored in the memory area when the calling message check key is pressed;

initializing the message table pointer value so as to point to an initial address of the message table when the calling message delete key has been pressed while maintaining the storage of the calling message to be erased in the memory area;

sequentially checking all of the areas of the message table when the erased calling message recovery key has been pressed; and increasing the initialized the message table pointer value every time that the area storing address of the memory area in areas of the message table has been checked.

4. An apparatus for recovering an erased calling message in a radio pager comprising:

a micro-controller;

a memory, controlled by said micro-controller, comprising a memory area for sequentially storing calling messages, and a message table which comprises a first area and a second area and stores addresses of the memory area where calling messages are stored;

an operation panel, providing signals to said micro-controller, which has a calling message delete key and an erased calling message recovery key;

a display, connected to said micro-controller, for displaying calling messages stored in a selected address when an address of the memory area stored in the first area of said message table is selected;

said micro-controller moving an address of the memory area where a calling message to be erased is stored among the addresses stored in the first area of the message table into the second area, while maintaining the storage of the calling message to be erased in the memory area when the calling message delete key has been pressed;

said micro-controller rearranging remaining addresses stored in the first area except for the address moved into the second area; and said micro-controller moving a selected address into the rearranged first area when the erased calling message recovery key has been pressed and simultaneously selecting one address of the addresses stored in the second area.

5. An apparatus for recovering an erased calling message in a radio pager comprising:

a micro-controller;

a memory, controlled by said micro-controller, comprising a memory area for sequentially storing calling messages, and a message table which comprises a first area and a second area and stores addresses of the memory area where calling messages are stored;

an operation panel, providing signals to said micro-controller, which has a calling message check key, a calling message delete key and an erased calling message recovery key;

said micro-controller storing a calling message received in an address pointed to by a message table pointer from among addresses of the memory area stored in the first area of the message table;

a display, connected to said micro-controller, for displaying all of the calling messages stored in addresses of the memory area stored in the first area of the message table when the calling message check key has been pressed;

said micro-controller moving an address of the first area of the message table storing address of the memory area where a calling message to be erased is stored into the second area when one calling message of the calling messages is displayed and the calling message delete key has been pressed while maintaining the storage of the calling message to be erased in the memory area;

said micro-controller reducing a message table pointer value pointing to an address of the message table which is storing the address of the memory area for storing a received calling message and generating an erasure pointer pointing to the address for storing the address of the first area of the message table intended to be next moved, when the address of the first area of the message table is moved into the second area of the message table;

said micro-controller rearranging remaining addresses stored in the first area except for the address moved into the second area;

said micro-controller moving a selected address into the first area when the erased calling message recovery key has been pressed and simultaneously selecting one address of the addresses stored in the second area; and said micro-controller increasing the message table pointer value and reducing the generated erasure pointer value, when the selected address of the addresses stored in the second area of the message table is moved into the first area of the message table.

6. An apparatus for recovering an erased calling message in a radio pager comprising:

a micro-controller;

a memory, controlled by said micro-controller, comprising a memory area for sequentially storing calling messages and a message table for storing addresses of the memory area where calling messages are stored;

an operation panel, providing signals to said micro-controller, which has a calling message check key, a calling message delete key and an erased calling message recovery key;

said micro-controller storing the calling message received in an address of the memory area stored in an address of the message table pointed to by a message table pointer;

a display, connected to said micro-controller, for the pager for displaying calling messages stored in the memory area when the calling message check key is pressed;

said micro-controller initializing the message table pointer value so as to point to an initial address of the message table when the calling message delete key has been pressed while maintaining the storage of the calling message to be erased in the memory area;

said micro-controller sequentially checking all of the areas of the message table when the erased calling message recovery key has been pressed; and said micro-controller increasing the initialized the message table pointer value every time that the area storing address of the memory area in areas of the message table has been checked.

* * * * *